US005683511A

United States Patent [19]

Kremers et al.

[11] Patent Number: 5,683,511

[45] Date of Patent: Nov. 4, 1997

[54] APPARATUS FOR APPLYING LIQUID TO A YARN SHEET

[75] Inventors: Arnold Kremers; Helmut Knoll; Volker Knoll; Reiner Schmitt; Volker Ruschenbaum, all of Heinsberg; Gerhard Grebing, Wuppertal; Werner Tobergte, Erlenbach; Hans-Joachim Schaupp, Obernburg; Gerhard Nitschke, Erkelenz; Heinrich Wallraven, Heinsberg, all of Germany

[73] Assignee: Akzo Nobel NV, Arnhem, Netherlands

[21] Appl. No.: 586,665

[22] PCT Filed: May 6, 1995

[86] PCT No.: PCT/EP95/01730

§ 371 Date: Mar. 18, 1996

§ 102(e) Date: Mar. 18, 1996

[87] PCT Pub. No.: WO95/32141

PCT Pub. Date: Nov. 30, 1995

[30] Foreign Application Priority Data

May 25, 1994 [DE] Germany ..... 44 18 144.2

[51] Int. Cl.[6] ..... B05C 3/12

[52] U.S. Cl. ..... 118/420; 118/36; 118/405; 118/419; 118/428; 118/429; 68/11; 68/175; 68/200; 8/151.2

[58] Field of Search ..... 118/36, 405, 419, 118/420, 428, 429; 65/443, 483, 529; 68/11, 175, 200; 8/151.2

[56] References Cited

U.S. PATENT DOCUMENTS

| | | | |
|---|---|---|---|
| 2,093,857 | 9/1937 | Williamson et al. | 118/420 |
| 2,373,078 | 4/1945 | Kleist | 118/420 |
| 2,943,598 | 7/1960 | Newton | 118/420 |
| 4,042,360 | 8/1977 | Kane et al. | 65/11 |
| 4,059,068 | 11/1977 | Guillermin et al. | 118/420 |
| 4,095,558 | 6/1978 | Ellegast et al. | 118/420 |
| 4,217,323 | 8/1980 | Foster et al. | 8/151.2 |
| 4,255,473 | 3/1981 | Williams, Jr. | 427/445 |
| 4,457,034 | 7/1984 | Simmen | 8/151.2 |
| 5,501,734 | 3/1996 | Oliphant | 118/234 |

FOREIGN PATENT DOCUMENTS

| | | | |
|---|---|---|---|
| 2321563 | of 1976 | France | D06B 1/00 |
| 2 045 142 | 9/1970 | Germany | D01H 13/30 |
| 2 433 507 | 7/1974 | Germany | D01H 13/30 |
| 7 442 133 | 12/1974 | Germany | D01H 13/30 |
| 116 267 | 11/1975 | Germany | D01H 13/30 |
| 3 412 039 | 3/1984 | Germany | B65H 71/00 |
| 3 423 942 | 6/1984 | Germany | B65H 71/00 |
| 4 418 144 | 6/1994 | Germany | B65H 71/00 |
| 148 730 | 5/1930 | Switzerland | D65H 7/100 |
| 632 118 | 7/1980 | Switzerland | D01H 13/30 |
| 346 150 | 4/1930 | United Kingdom | D01H 13/30 |

*Primary Examiner*—Donald E. Czaja
*Assistant Examiner*—Michael P. Colaianni
*Attorney, Agent, or Firm*—Joseph M. Noto; Louis A. Morris

[57] ABSTRACT

An apparatus for applying a liquid to threads of a yarn sheet. The apparatus comprises multiple thread wetting elements, each of which has at least one thread guide groove for each thread. In the thread guide groove the thread travels with the liquid and each thread guide groove has one associated liquid feed bore or groove for supplying the liquid to the thread guide groove. The liquid feed bore or groove terminates in the thread guide groove. There is a liquid distributor which is implemented as a support to which the thread wetting elements are attached and which supplies liquid feed to each liquid bore or groove. The separation of adjacent thread guide grooves is 2 to 30 mm, and adjacent thread guide grooves are different distances from the liquid distributor such that the thread guide grooves are offset in an alternating manner.

4 Claims, 5 Drawing Sheets

APPARATUS FOR APPLYING LIQUID TO A YARN SHEET

BACKGROUND OF THE INVENTION

1. Field of the Invention

The invention relates to an apparatus for applying liquid to a yarn sheet.

2. Description of the Related Art

Such an apparatus is known from DE-A 34 12 039. Here, the liquid is fed to the yarn sheet via a liquid-permeable surface consisting of a sintered material. The liquid-permeable surface can have grooves. Since the distance traveled by the liquid through the liquid-permeable surface with grooves varies, uniform delivery of liquid to the individual threads is not guaranteed. While a relatively large amount of liquid is discharged at the bottom of the groove, only a slight amount of liquid is observable on the walls. For this reason, it is apparently recommended to use two such surfaces situated opposite each other with respect to the yarn sheet. Moreover, a disadvantage of using sintered material is that it clogs pointwise after extended use, so that after a time, when used to apply liquid to threads of a yarn sheet, not all threads are supplied with the same quantity of liquid. If this occurs, the entire sintered-material body must be replaced. A further disadvantage is that the known apparatus can be adapted only at great expense to yarn sheets of differing thread counts and/or thread separations.

Although, in applying liquid to individual threads, thread wetting elements are known that have a thread guide groove and a liquid feed associated with the thread guide groove, their liquid feeds are supplied by delivery lines (DE-U-74 42 133, DE-A-24 33 507). These apparatus are very costly, since all delivery lines to the liquid feeds must be supplied with the same amount of liquid, something usually achieved by making the lines equally long. These apparatus are fully unsuitable for applying liquid to threads of a yarn sheet, because the known apparatus provided to treat individual threads would require large thread separations. Consequently, an enormous amount of space is needed for such an apparatus. For this reason, the known thread wetting elements for wetting individual threads have been rejected for use in wetting yarn sheets.

The objective of the present invention is to implement an apparatus for applying liquid to threads of a yarn sheet, having a thread guide groove for each thread, a liquid feed terminating in the thread guide groove, with all liquid feeds being supplied by a liquid distributor, in such a way that liquid application is uniform and the apparatus can be adapted in a particularly simple manner to differing thread counts and/or thread separations.

SUMMARY OF THE INVENTION

The above objective is met by an apparatus for applying a liquid to threads of a yarn sheet which comprises multiple thread wetting elements, each of which has at least one thread guide groove for each thread. In the thread guide groove the thread travels with the liquid in a direction from the thread feed end to the thread exit end and each thread guide groove has one associated liquid feed bore or groove for supplying the liquid to the thread guide groove. The liquid feed bore or groove terminates in the thread guide groove. There is a liquid distributor which is implemented as a support to which the thread wetting elements are attached and which supplies liquid feed to each liquid bore or groove.

The separation of adjacent thread guide grooves is 2 to 30 mm, and adjacent thread guide grooves are different distances from the liquid distributor such that the thread guide grooves are offset in an alternating manner.

DESCRIPTION OF THE PREFERRED EMBODIMENTS

Figure 1:
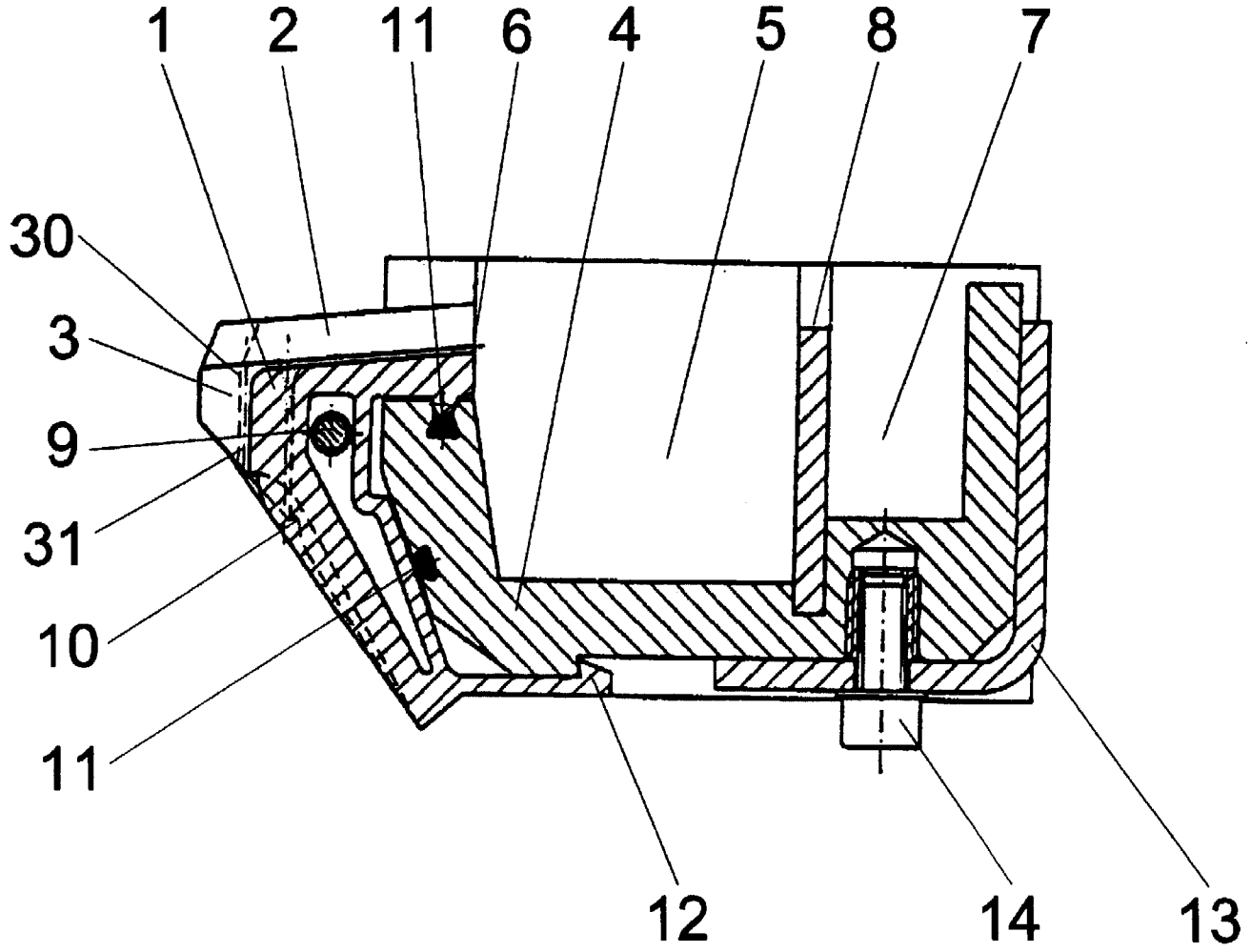
FIG. 1 shows a cross-section through an apparatus of the invention.

Surprisingly, it turns out that the apparatus of the invention is not only suited to applying liquids such as finishing agents, antistatic agents, winding oils, sizes, dyes, etc., but can also be used in the production of mono- or multifilament threads to apply liquids to these threads whose purpose is to fully cure the yet-incomplete thread or to wash out or introduce chemicals from or into the threads. In this case, the apparatus of the invention allows dispensing in many cases with the baths common up to now, in which the yarn sheets must be repeatedly immersed. An example is use of the apparatus of the invention for liquid aftertreatments of mono- or multifilament threads spun using solvent mixtures, such as from cellulosic materials like cuprammonium, viscose, or NMMO; aramides, etc.

The apparatus of the invention is distinguished in particular by the fact that the separation of adjacent thread guide grooves can be freely selected and adapted to existing requirements by exchanging the wetting elements. A separation of adjacent thread guide grooves of 2 to 30 mm, especially of 3 to 4 mm, has proven fully satisfactory.

If the thread separations of the yarn sheet are small, the apparatus of the invention has proven particularly effective when successive thread guide grooves are different distances from the liquid distributor, such that the thread guide grooves are offset in an alternating manner. In this case, an offset of adjacent thread guide grooves of 2 to 10 mm can be regarded as particularly advantageous. Even if the thread separation in the yarn sheet is small, this ensures that, especially in the treatment of still-sensitive threads, adjacent threads cannot adhere to one another or influence one another in any way.

Application of the apparatus of the invention for yarn sheets of varied thread counts and/or thread separations is particularly advantageous when the thread wetting elements have 2 to 20 thread guide grooves.

In this case, it has proven especially satisfactory for each thread wetting element to be attached to the liquid distributor via a spring catch.

If the thread treatment is particularly effective at elevated temperature, the liquid distributor of the apparatus of the present invention should contain heating devices that maintain the temperature of the liquid in the liquid distributor constant over its length.

It is especially advantageous for the liquid feeds to be arranged such that they terminate in the thread guide groove at the thread feed end. This allows the entire length of the liquid groove to be available for liquid application.

For liquid treatments performed on threads still sensitive to mechanical stress, it has proven satisfactory to implement the liquid feeds such that delivery of the liquid to the thread guide grooves is at least substantially laminar and such that the liquid feeds form an angle of 60° to 90° to the direction of travel in the thread guide groove. If the thread guide groove contains a thread under treatment, the liquid is applied to the thread at an angle of 60° to 90°.

To the extent permitted by thread stability, and depending on the treatment, it can also be advantageous for the liquid feeds to be implemented such that liquid delivery to the thread guide grooves is at least substantially turbulent and such that the liquid feeds form an angle of 10° to 80° to the direction of travel in the thread guide groove. This can intensify the treatment of the threads. Especially with multifilament threads, delivery of turbulent liquid can force separation of the thread filaments, allowing uniform treatment of each individual filament.

The apparatus of the present invention is particularly simple when the liquid feeds are grooves. It has proven especially satisfactory for the liquid distributor to have an overflow for the liquid and for the thread wetting elements to be arranged on the liquid distributor such that the overflowing liquid is delivered to the liquid feeds. By exact horizontal alignment of the overflow edge and by maintaining the level in the liquid distributor constant, it can easily be ensured that each thread receives the same or at least approximately the same amount of liquid.

Interaction of adjacent threads of the yarn sheet can be prevented in a particularly effective manner if means of separation from the adjacent thread are present at the end of each thread guide groove in the direction of thread travel, in order to prevent the liquid film from jumping to the adjacent thread. Additional devices ensure proper liquid discharge at unoccupied locations, thereby avoiding an influence on adjacent occupied locations. Examples of such means are cited in DE-U-74 42 133 and DE-A-24 33 507.

The apparatus of the invention will now be explained in more detail with reference to the above figures.

Figure 2:
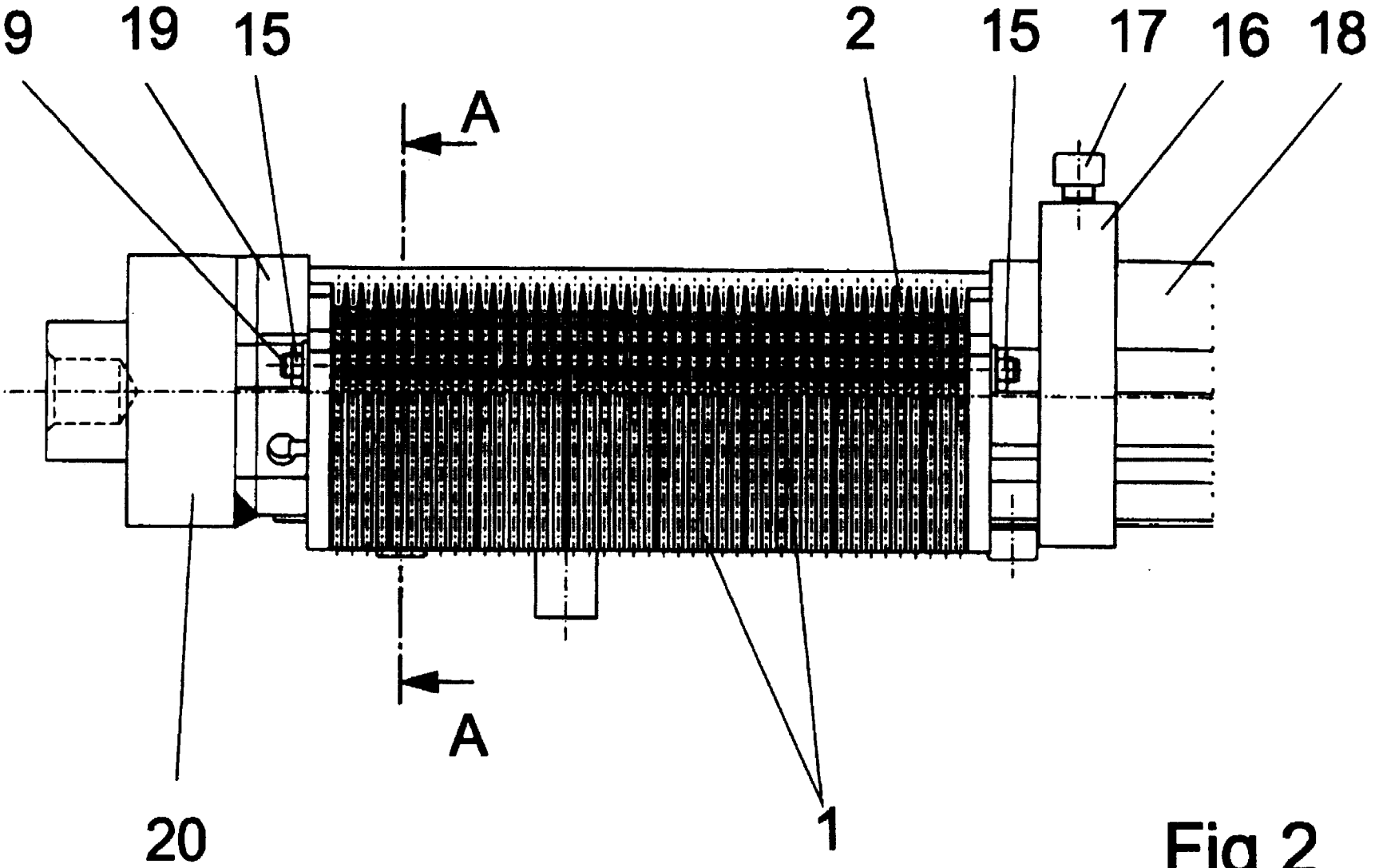
FIG. 2 shows a side view of the apparatus of FIG. 1.
Figure 3:
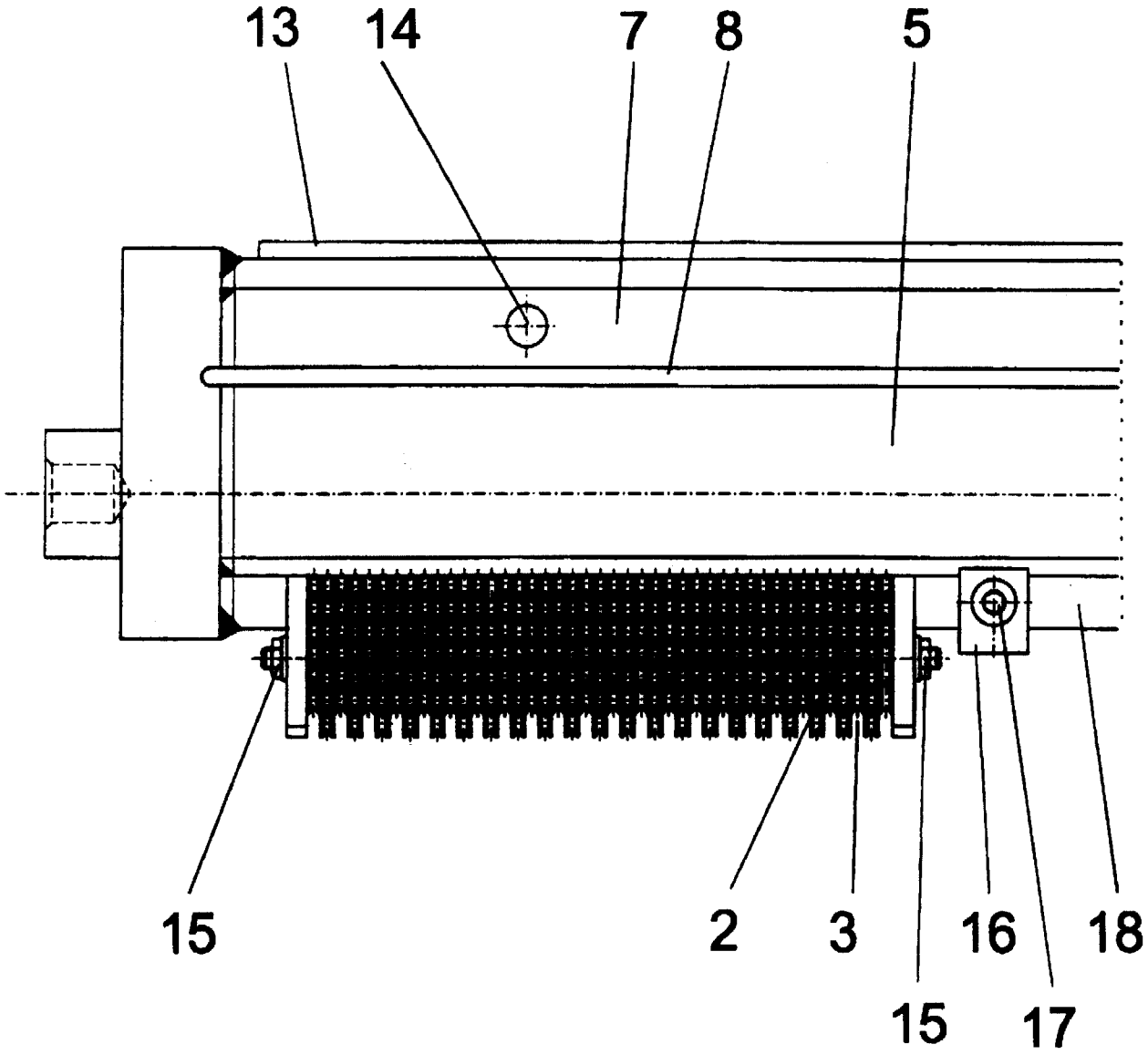
FIG. 3 shows the plan view of the apparatus of FIG. 1.

FIG. 1 shows a cross-section, FIG. 2 a side view, and FIG. 3 a plan view of an apparatus of the invention. Thread wetting element 1 has a liquid feed in the form of a groove 2, which runs at an angle of about 80° to the direction of thread travel, the direction of thread guide groove 3. The thread guide groove 3 having a thread feed end 30 and thread exit end 31. Thread wetting element 1 is connected to a liquid distributor 4 via spring catch 12. Liquid distributor 4 has a reservoir 5, from which the liquid (not shown) is delivered via overflow 6 to liquid feed groove 2. The amount of liquid fed to each individual thread can be controlled and held constant by adjusting the level of overflow 8 into discharge channel 7. Liquid distributor 4 is attached to support 13 via bolts 14. Support 13 is the link to an apparatus (not shown) for treating or producing threads, which pass through this apparatus (not shown) as a yarn sheet. Multiple thread wetting elements 1 are joined together via a threaded rod 9 and two nuts 15. At the end of thread guide groove 3 (in the direction of travel), thread wetting elements 1 have means for discharging excess liquid in the form of a specially shaped groove 10. Thread wetting element 1 is sealed off from the liquid distributor 4 by seals 11. Sealing walls 18, which are attached to the liquid distributor via support 16 and bolts 17, prevent the liquid from overflowing from the liquid distributor 4 other than at the thread wetting elements 1. The apparatus of the invention can easily be adapted to any thread count by varying the number of thread wetting elements 1, which in the case shown have 6 thread guide grooves 3. In this case, in which each individual thread wetting element 1 has six thread guide grooves 3, wetting of threads can be accomplished for yarn sheets with a multiple of 6 threads, for example, 48, 60, 144. If in the illustrated example the thread count is not divisible by 6, either individual thread guide grooves can remain unoccupied, since the liquid supplied to an unoccupied thread guide groove 3 is discharged via discharge groove 10 into a capture basin (not shown), or a single thread wetting element 1 with a different number of thread guide grooves 3 can be used on the end. Liquid distributor 4 is terminated on both sides by stops 19 and side walls 20, whereby the figures show only one side, with liquid distributor 4 partially shown (dotted line) on the other side.

Figure 4:
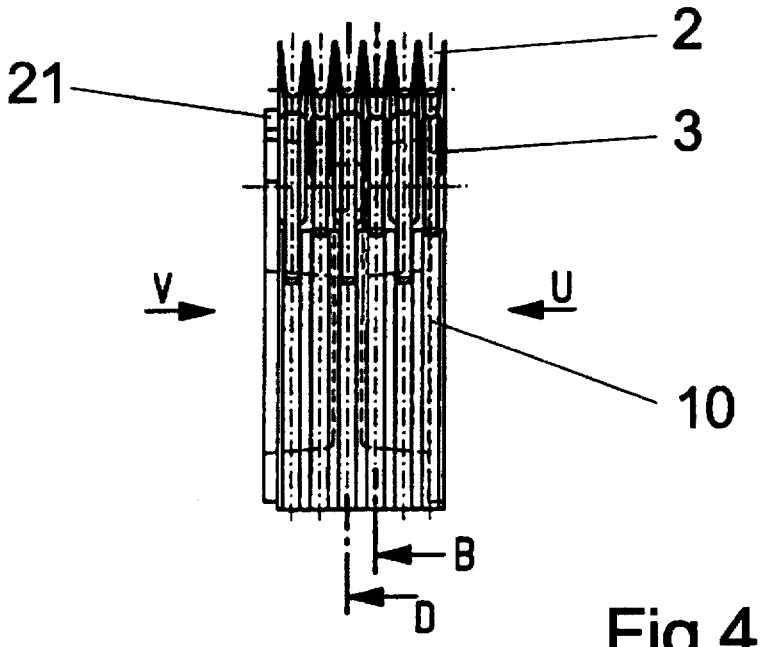
FIG. 4 shows a side view of an individual thread wetting element of the apparatus of FIGS. 1 to 3.
Figure 5:
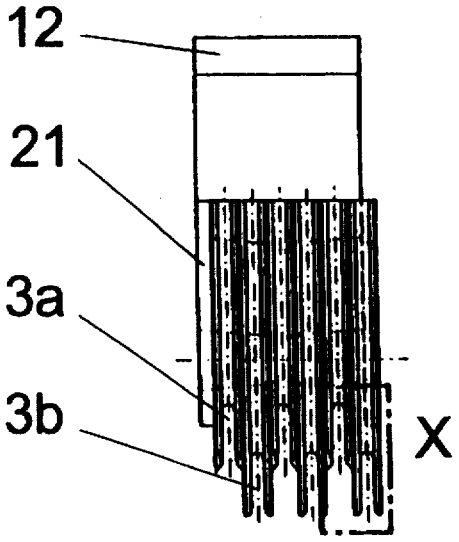
FIG. 5 shows the plan view of the thread wetting element of FIG. 4.
Figure 6:
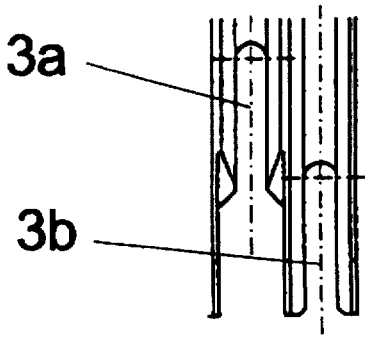
FIG. 6 shows detail X of FIG. 5.

An individual thread wetting element is shown in FIG. 4 in side view and in FIG. 5 in plan view. The liquid feed in the form of a groove is again labeled 2 and the thread guide groove 3. The thread wetting element has a tongue 21, by which it can be plugged into the next thread wetting element via a corresponding recess (no. 24 in FIG. 7). The thread guide grooves 3 are different distances from the liquid distributor (not shown), so that thread guide grooves 3*a* and 3*b* are arranged at alternating distances from the liquid distributor. This is again emphasized clearly in FIG. 6, which depicts detail X of FIG. 5.

Figure 7:
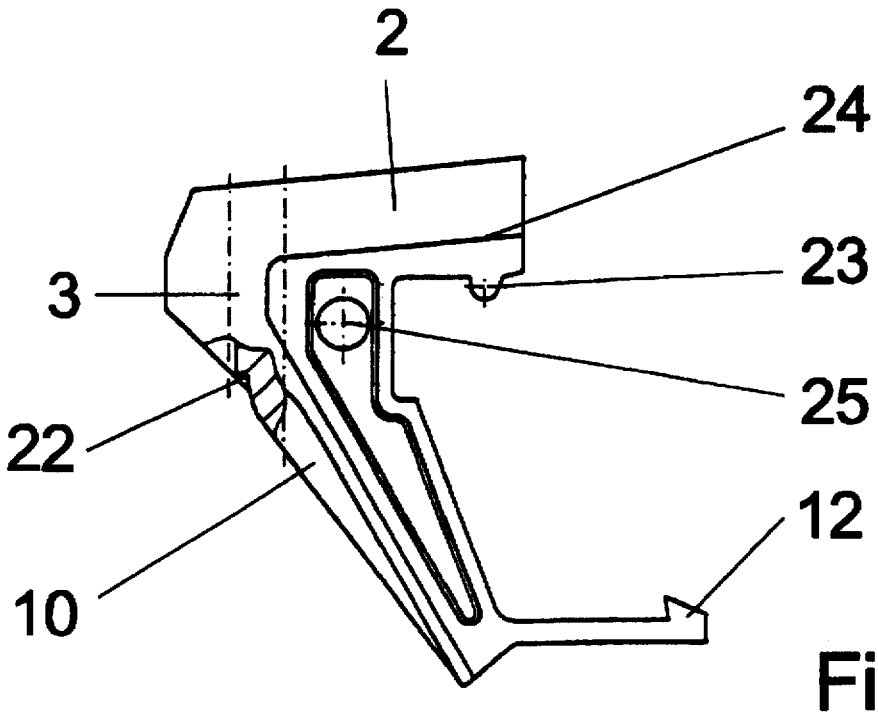
FIG. 7 shows view U of the thread wetting element of FIG. 4.
Figure 8:
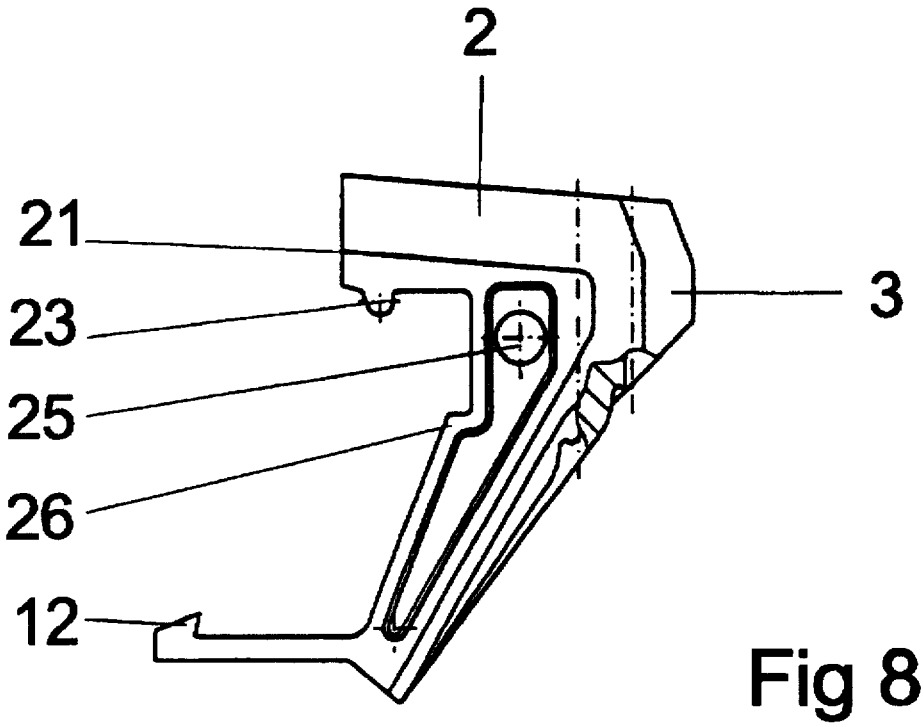
FIG. 8 shows view V of the thread wetting element of FIG. 4.

FIG. 7 shows another side view of thread wetting element 1. This side view is labeled U in FIG. 4, while FIG. 8 shows the side view of this thread wetting element labeled V. In a particularly simple manner, all thread wetting elements can be clamped onto liquid distributor 4 via stud 23, which as shown in FIG. 1 engages seal 11, via the elastic part 26 of thread wetting element 1, and via spring catch 12. The thread wetting elements can be clamped onto the liquid distributor either individually, in which case all thread wetting elements are then pushed together via threaded rod 9 and nuts 15, or, if the weight permits, plugged and bolted together in advance and then clamped onto the liquid distributor as a unit. Each thread wetting element has a bore 25 for threaded rod 9. To improve the discharge of excess liquid, liquid discharge groove 10 has a notch 22, which is effective in preventing dripping at the end of thread guide groove 3.

We claim:

1. An apparatus for applying a liquid to threads of a yarn sheet comprising multiple thread wetting elements, multiple thread guide grooves each having a thread feed end and a thread exit end, each of said thread wetting elements having associated with it at least one of said thread guide grooves, multiple liquid feed bores or grooves for supplying said liquid one of which terminates in each of said thread guide grooves, a liquid distributor which is implemented as a support to which said thread wetting elements are attached and which supplies liquid feed to each said liquid bore or groove, each of said threads of said yarn sheet traveling within one of said thread guide grooves with said liquid, the direction of travel of said threads being from said thread feed end to said thread exit end of said thread guide grooves, there being a separation of adjacent thread guide grooves of from 2 to 30 mm, and adjacent thread guide grooves being different distances from said liquid distributor such that said thread guide grooves are offset in an alternating manner.

2. The apparatus of claim 1 wherein said separation of adjacent thread guide grooves is from 3 to 4 mm.

3. The apparatus of claim 1 wherein said liquid feed is supplied such that delivery of said liquid to each said thread guide groove is at least substantially laminar and each said liquid feed bore or groove forms an angle of 60° to 90° to the direction of travel of thread in said thread guide groove.

4. The apparatus of claim 1 wherein said liquid feed is supplied such that delivery of said liquid to each said thread guide groove is at least substantially turbulent and each said liquid feed bore or groove forms an angle of 10° to 80° to the direction of travel of thread in said thread guide groove.

* * * * *